United States Patent [19]

Nakano

[11] Patent Number: 4,978,406

[45] Date of Patent: Dec. 18, 1990

[54] PROCESS FOR PRODUCING TUBE

[75] Inventor: Hiroyuki Nakano, Osaka, Japan

[73] Assignee: Showa Products Company, Osaka, Japan

[21] Appl. No.: 342,964

[22] Filed: Apr. 25, 1989

[51] Int. Cl.[5] ..... B31C 13/00

[52] U.S. Cl. ..... 156/190; 156/192; 156/195; 156/209; 156/219; 493/297

[58] Field of Search ..... 156/184, 190, 191, 192, 156/193, 204, 199, 209, 219, 195; 493/297; 229/4.5; 138/129, 144

[56] References Cited

U.S. PATENT DOCUMENTS

| | | | |
|---|---|---|---|
| 1,885,587 | 11/1932 | Burton | 156/190 X |
| 2,932,597 | 4/1960 | John et al. | 156/190 |
| 3,156,401 | 11/1964 | Krause | 493/297 X |
| 3,245,855 | 4/1966 | Stenvall | 156/209 X |
| 4,717,374 | 1/1988 | Elias | 156/190 X |

*Primary Examiner*—David Simmons

*Assistant Examiner*—Thi Dang

*Attorney, Agent, or Firm*—Dennison, Meserole, Pollack & Scheiner

[57] ABSTRACT

A process for producing a tube having a strength imparting tubular body and a tubular lining member covering and bonded to the inner surface of the tubular body comprises the steps of forming mandrel contact portions on a synthetic resin surface of a lining sheet in the form of a strip and noncontact portions in the surface distributedly among the contact portions, helically winding the lining sheet around a mandrel with the synthetic resin surface positioned inside and with the sheet lapping over itself, bonding the lap to the underlying portion of the wound sheet to form the lining member, and moving the tubular lining member axially of the mandrel in a direction to remove the member therefrom. The lining member formed around the mandrel is smoothly movable axially thereof by virtue of the presence of the contact and noncontact portions distributedly formed over the sheet resin surface.

5 Claims, 4 Drawing Sheets

PROCESS FOR PRODUCING TUBE

BACKGROUND OF THE INVENTION

The present invention relates to a process for producing tubes which comprise a strength imparting tubular body and a tubular lining member covering the inner surface of the tubular body and bonded to the body and which are useful as containers, cores, bobbins, poles and the like.

The terms "inner" and "outer" are used herein and in the appended claims based on the tube produced.

For example, the trunks of containers are produced from a tube which comprises a strength imparting tubular body of paper, a tubular lining member covering and bonded to the inner surface of the tubular body and having a synthetic resin inner surface, and a tubular outer covering member provided around the outer surface of the tubular body, by cutting the tube in a specified length. The container is formed by securing a top closure and a bottom closure to the upper and lower ends of the trunk thus obtained.

The tube is conventionally prepared by helically winding around a mandrel a lining forming sheet in the form of a strip and having at least one synthetic resin surface, with the resin surface positioned inside and with a lap formed between the adjacent portions of the strip, helically winding a strip of body forming thick paper around the winding, further winding a covering forming sheet in the form of a strip around the paper winding, moving the combined winding axially of the mandrel in a direction to remove the winding from the mandrel, and bonding the lapping portions of the strip materials.

With the conventional method described above, however, the combined winding around the mandrel is not smoothly movable axially of the mandrel owing to the friction between the synthetic resin inner surface of the lining sheet, with the result that the synthetic resin is melted by the heat of friction to adhere the lining sheet to the mandrel.

SUMMARY OF THE INVENTION

The main object of the present invention is to overcome the above problem and to provide a process for producing a tube wherein the combined winding around the mandrel can be slidingly moved smoothly axially of the mandrel.

To fulfil the above object, the present invention provides a process for producing a tube as formed around a mandrel, the tube comprising a strength imparting tubular body and a tubular lining member covering the inner surface of the tubular body and bonded to the body, the process comprising the steps of forming a mandrel contact portion on a synthetic resin surface of a lining sheet in the form of a strip and a noncontact portion in the resin surface; helically winding the lining sheet around the mandrel with the synthetic resin surface positioned inside and with the sheet lapping over itself; bonding the lap to the underlying portion of the wound sheet to form the tubular lining member; and moving the tubular lining member axially of the mandrel in a direction to remove the member from the mandrel.

The tube can be produced also by a process which comprises the steps of forming a multiplicity of projections on and a multiplicity of recesses in a synthetic resin surface of a lining sheet in the form of a strip, the recesses being positioned as distributed among the projections; helically winding the lining sheet around the mandrel with a lap formed at one side edge of the sheet and with the synthetic resin surface positioned inside; bonding the lap of the wound sheet to form the tubular lining member; and moving the tubular lining member axially of the mandrel in a direction to remove the member from the mandrel.

With the process of the present invention, the synthetic resin surface of the lining sheet wound directly around the mandrel contacts the mandrel over a reduced area to diminish the friction therebetween. Accordingly, the tubular lining member formed by directly winding the lining sheet around the mandrel is smoothly slidable relative to the mandrel. This obviates the likelihood that the synthetic resin will adhere to the mandrel on melting.

DESCRIPTION OF THE PREFERRED EMBODIMENTS

Examples of sheets which are used in the form of a strip for forming the lining member are laminates of a synthetic resin film and a reinforcing material such as paper, aluminum foil, high-strength synthetic resin film or composite sheet made of such materials; a reinforcing material, such as paper, aluminum foil, high-strength synthetic resin film or composite sheet of such materials, which is coated with a synthetic resin over one surface thereof; a synthetic resin film coated with aluminum over one surface thereof by vacuum evaporation; film made singly of a synthetic resin. Also usable in a synthetic resin film coated with a reinforcing synthetic resin over one surface thereof. In this case, it is desirable to coat the film with the resin immediately before the lining sheet is wound around the mandrel.

The inner resin surface of the lining sheet in the form of a strip is formed with a contact portion to be in contact with the peripheral surface of the mandrel and a noncontact portion to be out of contact therewith. For example, the contact portion comprises a multiplicity of projections formed as distributed over the inner synthetic resin surface of the lining sheet. In this case, the remaining portion of the surface is the noncontact portion. As another example, the noncontact portion is in the form of a multiplicity of recesses formed in the inner synthetic resin surface of the sheet as distributed over the surface area. In this case, the remaining portion of the surface is the contact portion. These projections or recesses are formed, for example, by embossing or creping the sheet.

The process of the invention will be described with reference to the accompanying drawings for illustrative purposes.

Figure 7:
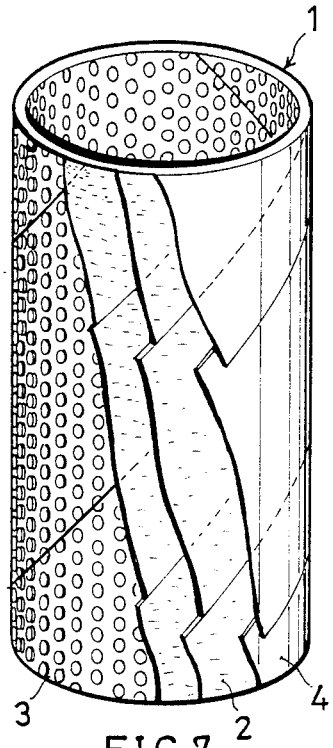
FIG. 7 is a perspective view partly broken away and showing a tube produced by the process of the invention.
Figure 8:
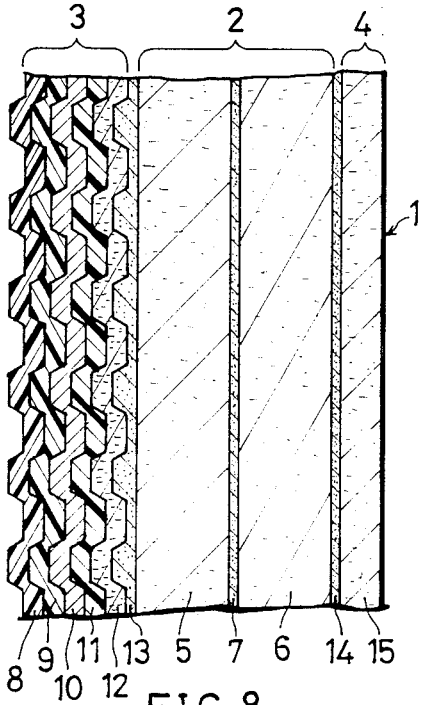
FIG. 8 is an enlarged view in vertical section showing the peripheral wall of the tube produced by the process of the invention.

With reference to FIGS. 7 and 8 showing an example of tube 1 produced by the present process, the tube 1, which is used for providing the trunks of containers, comprises a strength imparting tubular body 2, a tubular lining member 3 covering the inner surface of the tubular body 2, and a tubular outer covering member 4 formed over the tubular body 2.

The tubular body 2 comprises inner and outer two sheets of thick paper 5, 6 bonded to each other with an adhesive 7 into a double wall. The tubular lining member 3 comprises an unstretched polyethylene terephthalate film 8 (hereinafter referred to as "unstretched PET film"), a stretched polyethylene terephthalate film 9 (hereinafter referred to as "stretched PET film") laminated to the outer surface of the unstretched PET film 8, aluminum foil 10 laminated to the outer surface of the stretched PET film 9, a polyethylene film 11 laminated to the outer surface of the aluminum foil 10, and kraft paper 12 adhered to the outer surface of the polyethylene film 11. The kraft paper 12 is bonded to the inner thick paper 5 with an adhesive 13, whereby the tubular lining member 3 is bonded to the tubular body 2. The tubular outer covering member 4 comprises printing paper 15 and is bonded to the outer thick paper 6 with an adhesive 14. The outer covering member 4 need not always be provided. In this case, the outer surface of the outer thick paper 6 may bear a print.

Figure 1:
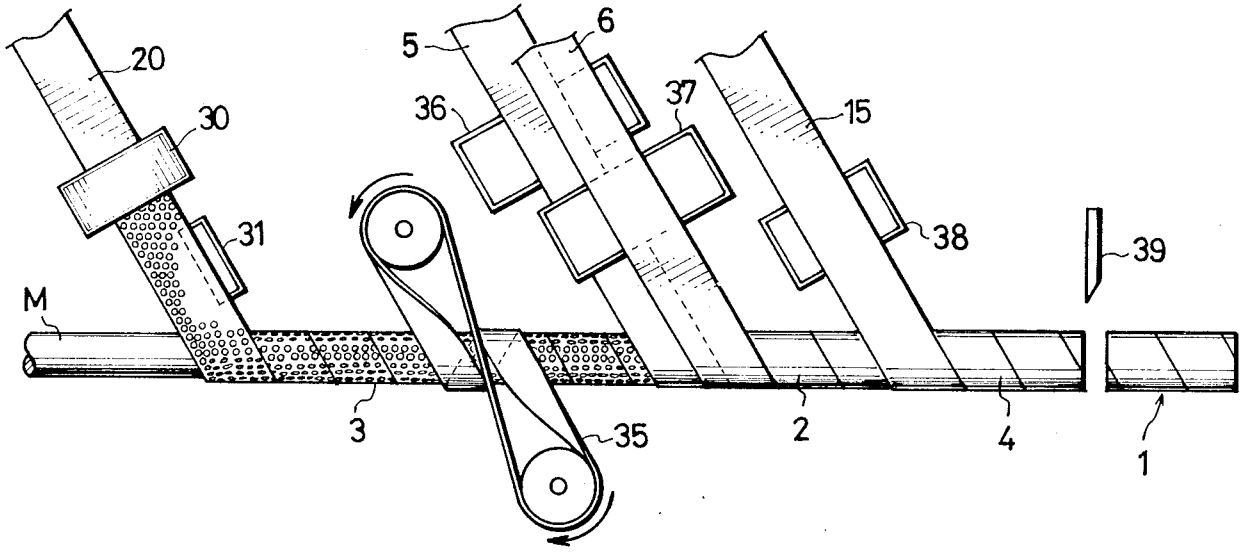
FIG. 1 is a plan view showing the process of the invention.

The process for producing the tube 1 will be described with reference to FIG. 1.

Figure 2:
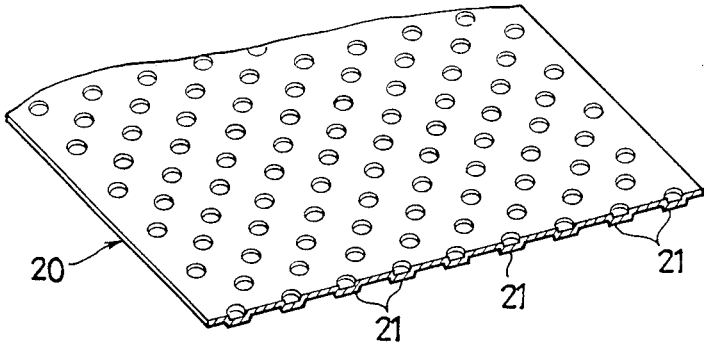
FIG. 2 is a fragmentary enlarged perspective view showing a lining sheet for use in the process of the invention.

First, a lining sheet 20 in the form of a strip and composed of the unstretched PET film 8, stretched PET film 9, aluminum foil 10, polyethylene film 11 and kraft paper 12 are helically wound around a mandrel M, with the film 8 positioned inside and with one side edge portion of the sheet 20 overlapping the other side edge portion thereof. The sheet 20 is for example about 0.1 mm in thickness. Before being wound around the mandrel M, the sheet 20 is embossed by an embossing device 30 disposed at one side of the mandrel M to form a multiplicity of circular projections 21 on the surface of the unstretched PET film 8 (see FIG. 2). The projections 21 on the surface of the film 8 serve as the portions to be brought into contact with the mandrel M, and the remaining portion of the film surface is held out of contact with the mandrel. When the projections 21 are, for example, 0.3 to 0.4 mm in diameter, about 300 to about 600 projections are formed per $cm^2$. The surface of the unstretched PET film 8 of the sheet 20 is precoated at one side edge portion thereof with an adhesive by an applicator 31 and is bonded to the kraft paper 12 at the overlapping other side edge portion of the lining sheet 20. In this way, the tubular lining member 3 is formed.

Figure 3:
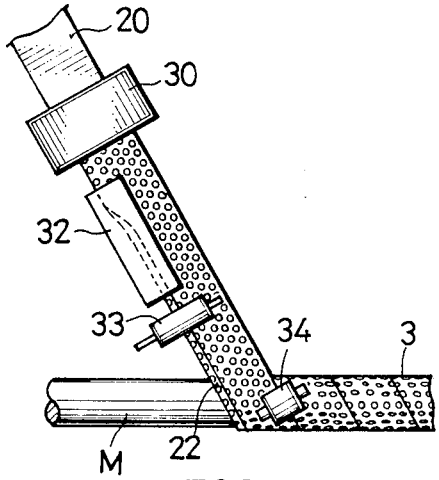
FIG. 3 is a fragmentary plan view showing a different method of bonding the lap of the lining sheet.

The lap of the sheet 20 wound around the mandrel M helically may be bonded in the manner shown in FIG. 3. Before the sheet 20 is wound around the mandrel M with projections 21 formed on the sheet by the embossing device 30, the sheet 20 is outwardly folded as at 22 at one side edge portion thereof by a folding device 32. The folded portion 22 is pressed on by a pressure roller 33 to expose the unstretched PET film 8. The sheet 20 is then helically wound around the mandrel M so that the inner surface of the sheet 20, i.e. the unstretched PET film 8, is lapped, at the other side edge portion of the sheet, over the outer surface of the folded portion 22, i.e., over the exposed film portion. The unstretched PET film 8 is then heat-sealed to itself at the lap by the application of heat and pressure by a heat roller 34.

The tubular lining member 3 formed around the mandrel M is moved axially of the mandrel M rightward, i.e. in a direction in which it is to be removed from the mandrel M, by a known belt drive device 35 while being rotated relative to the mandrel M.

Subsequently, a strip of inner thick paper 5 is helically wound around the tubular inner member 3 moving rightward in rotation, with one side edge portion of the strip lapping over the other side edge portion thereof. The surface of the thick paper 5 to be fitted around the tubular lining member 3 is precoated by an adhesive applicator 36 with the adhesive 13, which bonds the paper 5 to the lining member 3 including the slightly upraised side edge seam at 22. The thick paper 5 is so wound helically that the side edge seam of the paper 5 does not coincide with the side edge seam of the sheet 20. A strip of outer thick paper 6, precoated with the adhesive 7 by an adhesive applicator 37 over the surface thereof to be fitted around the inner thick paper 5, is thereafter helically wound around the inner thick paper 5, with one side edge portion of the strip lapping over the other side edge portion thereof. The paper 6 is adhered to the inner paper 5, with the lap adhered to the underlying side edge portion. In this way, the tubular body 2 is formed. The side edge seam of the outer paper 6 is formed out of coincidence with the side edge seam of the inner paper 5.

Finally, a strip of printing paper 15 (outer covering sheet in the form of a strip) is helically wound around the tubular body 2 with one side edge portion of the paper 15 lapping over the other side edge portion thereof. The surface of the printing paper 15 to be fitted around the tubular body 2 is also precoated by an adhesive applicator 38 with the adhesive 14, which adheres the paper 15 to the tubular body 2 and the lap to the underlying side edge portion, whereby the tubular outer covering member 4 is formed. The resulting assembly of lining member 3, tubular body 2 and covering member 4 is moved by the belt drive device 35 axially of the mandrel M rightward while being rotated relative to the mandrel M so as to be removed from the mandrel M. The elongated tubular assembly thus obtained is cut by a cutter 39 to a predetermined length, whereby lengths of tube 1 are produced.

In the above process, the lining member formed around the mandrel M is smoothly rotatable relative to the mandrel M and also smoothly movable axially thereof.

Figure 4:
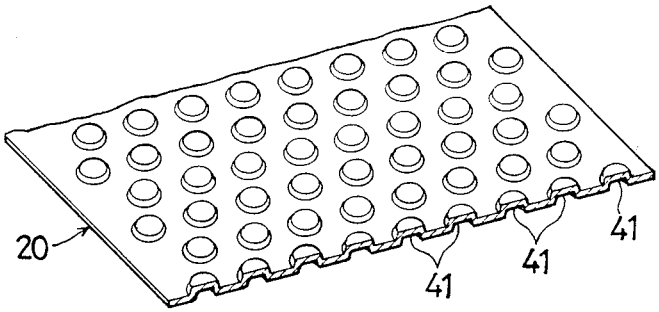
FIG. 4 is a fragmentary enlarged perspective view showing another example of lining sheet for use in the process of the invention.
Figure 5:
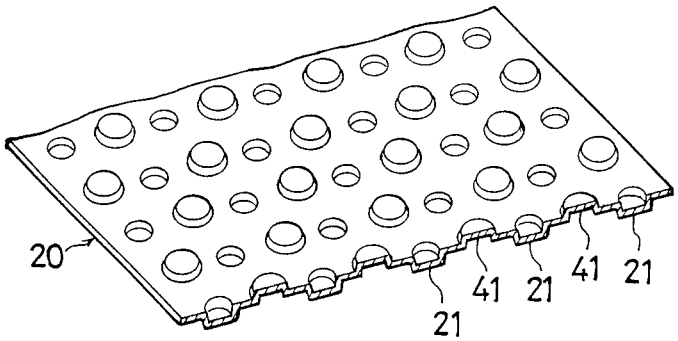
FIG. 5 is a fragmentary enlarged perspective view showing another example of lining sheet for use in the process of the invention.
Figure 6:
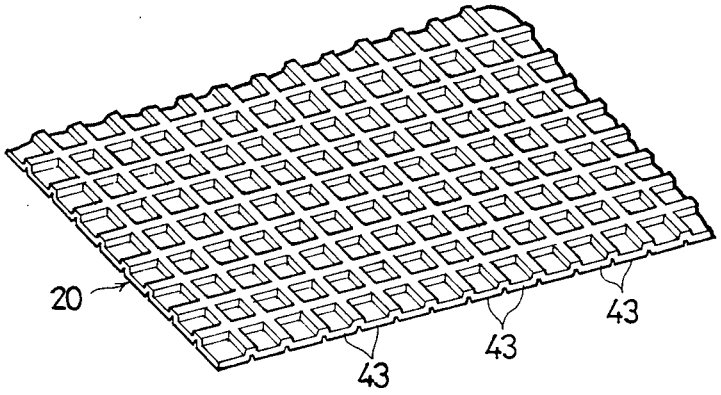
FIG. 6 is a fragmentary enlarged perspective view showing another example of lining sheet for use in the process of the invention.

FIGS. 4 to 6 show other examples of sheets each in the form of a strip for use in the process of the invention for forming the lining member.

With reference to FIG. 4 showing the first of these examples, the lining sheet 20 to be wound around the mandrel M is embossed by the embossing device disposed at one side of the mandrel M, whereby a multiplicity of circular recesses 41 are formed instead of circular projections 21 in the surface of the unstretched PET film 8. When the recess 41 is, for example, 0.3 to 0.4 mm in diameter, about 300 to about 600 recesses 41 are formed per $cm^2$. The recesses 41 in the surface of the film 8 are the portions to be held out of contact with the mandrel M, and the remaining surface portion serves as the portion to be brought into contact with the mandrel.

With reference to FIG. 5 showing the second of different examples, the lining sheet 20 to be wound around the mandrel M is embossed by the embossing device at one side of the mandrel M to form many circular projections 21 on and many circular recesses 41 in the surface of the unstretched PET film 8. The projections 21 are the portions to be brought into contact with the mandrel M, and the recesses 41 and the other remaining portion are noncontact portions.

With reference to FIG. 6 showing the third of different example, the lining sheet 20 to be wound around the mandrel M is embossed by the embossing device at one side of the mandrel M, whereby a multiplicity of square projections 43 are formed on the surface of the unstretched PET film 8. When the length of each side of the projection is, for example, 0.3 to 0.4 mm, about 300 to about 600 recesses 43 are formed per $cm^2$. The projections are the portions to be brought into contact with the mandrel M, with the remaining portion serving as the noncontact portion. The lining sheet 20 shown in FIG. 6 is usable as turned upside down.

The present invention may be embodied differently without departing from the spirit and basic feature of the invention. Accordingly, the embodiments herein disclosed are given for illustrative purposes only and are in no way limitative. It is to be understood that the scope of the invention is defined by the appended claims rather than by the specification and that all alterations and modifications within the definition and scope of the claims are included in the claims

What is claimed is:

1. A process for producing a tube as formed around a mandrel, the tube comprising a strength imparting tubular body and a tubular lining member covering the inner surface of the tubular body and bonded to the body, the process comprising the steps of:

forming a multiplicity of projections on and a multiplicity of recesses in a synthetic resin surface of a lining sheet in the form of a strip, the recesses being positioned as distributed among the projections, helically winding the lining sheet around a mandrel with a lap formed at one side edge of the sheet and with the synthetic resin surface positioned inside, so that the top ends of the projections contact a peripheral surface of the mandrel, bonding the lap to the underlying portion of the wound sheet to form the tubular lining member, and moving the tubular lining member axially of the mandrel in a direction to remove the member from the mandrel.

2. A process as defined in claim 1 wherein the lining sheet to be wound around the mandrel is folded over outward at one side edge thereof to form an outward folded portion and is then helically wound around the mandrel to lap the synthetic resin surface at the other side edge of the sheet over the folded portion, and the lap is bonded to the folded portion by heat sealing.

3. A process for producing a tube as formed around a mandrel, the tube comprising a strength imparting tubular body and a tubular lining member covering the inner surface of the tubular body and bonded to the body, the process comprising the steps of;

forming a multiplicity of projections on a synthetic resin surface of a lining sheet in the form of a strip;

helically winding the lining sheet around a mandrel with the synthetic resin surface positioned inside so that the top ends of the projections contact a peripheral surface of the mandrel and with the sheet lapping over itself;

bonding the lap to the underlining portion of the wound sheet to form the tubular lining member; and moving the tubular lining member axially of the mandrel in a direction to remove the member from the mandrel.

4. A process as defined in claim 3, wherein said projections are round and 0.3 to 0.4 mm in diameter and about 300 to about 600 projections are formed per cm.

5. A process as claimed in claim 3, wherein the lining sheet to be wound around the mandrel is folded over outward at one side edge thereof to form an outward folded portion and is then helically wound around the mandrel to lap the synthetic resin surface at the other side edge of the sheet over the folded portion, and the lap is bonded to the folded portion by heat sealing.

* * * * *